US008464365B1

(12) United States Patent
Nunn et al.

(10) Patent No.: US 8,464,365 B1
(45) Date of Patent: Jun. 18, 2013

(54) BREAKAWAY SPORTS PANTS WITH SEPARABLE ZIPPERS

(76) Inventors: Daron D Nunn, Bakersfield, CA (US); Vincent Trapani, Bay Shore, NY (US)

( * ) Notice: Subject to any disclaimer, the term of this patent is extended or adjusted under 35 U.S.C. 154(b) by 130 days.

(21) Appl. No.: 12/557,673

(22) Filed: Sep. 11, 2009

Related U.S. Application Data

(63) Continuation-in-part of application No. 11/650,365, filed on Jan. 8, 2007, now Pat. No. 8,127,370.

(51) Int. Cl.
*A41D 1/06* (2006.01)

(52) U.S. Cl.
USPC ..... 2/227

(58) Field of Classification Search
USPC ..... 2/227, 228, 229, 213, 339, 79, 2.15, 2/69; 606/217, 3; 24/435, 436
See application file for complete search history.

(56) References Cited

U.S. PATENT DOCUMENTS

| | | | | | |
|---|---|---|---|---|---|
| 1,934,179 | A | * | 11/1933 | Fischer | 2/339 |
| 2,132,117 | A | * | 10/1938 | Korolick | 2/228 |
| 2,177,599 | A | * | 10/1939 | Murphy | 24/436 |
| 2,190,608 | A | * | 2/1940 | Poux | 24/388 |
| 2,228,422 | A | * | 1/1941 | Thompson | 24/433 |
| 2,292,227 | A | * | 8/1942 | Kopyto | 2/67 |
| 2,341,331 | A | * | 2/1944 | Parkin | 24/436 |
| 2,343,480 | A | * | 3/1944 | Sansom | 2/213 |
| 2,381,359 | A | * | 8/1945 | Mikulas | 24/404 |
| RE22,715 | E | * | 1/1946 | Parkin | 24/436 |
| 2,520,026 | A | * | 8/1950 | Beitchman | 2/227 |
| 2,558,239 | A | * | 6/1951 | Disinger | 24/436 |
| 2,571,202 | A | * | 10/1951 | Clyne | 2/227 |
| 2,873,741 | A | * | 2/1959 | Donaldson | 606/217 |
| 2,923,009 | A | * | 2/1960 | Cookman | 2/227 |
| 3,329,144 | A | * | 7/1967 | Liman | 602/3 |
| 3,466,666 | A | * | 9/1969 | Otto | 2/227 |
| 3,711,865 | A | * | 1/1973 | Schifman | 2/79 |
| D231,155 | S | * | 4/1974 | Bowcut | D2/742 |
| 3,800,330 | A | * | 4/1974 | Bowcut | 2/227 |
| 3,801,986 | A | * | 4/1974 | Purdon | 2/69 |
| 4,569,087 | A | * | 2/1986 | Kerwin | 2/69 |
| 4,638,509 | A | * | 1/1987 | Charron | 2/2.15 |
| 4,752,992 | A | * | 6/1988 | Kondo et al. | 24/436 |
| 4,914,756 | A | * | 4/1990 | Grassick | 2/227 |
| 5,008,962 | A | * | 4/1991 | Smith et al. | 2/234 |
| 5,033,126 | A | * | 7/1991 | Wruck et al. | 2/242 |
| 5,315,716 | A | * | 5/1994 | Baum | 2/227 |
| 5,706,523 | A | * | 1/1998 | Witzel | 2/238 |
| 5,745,960 | A | * | 5/1998 | Dishner et al. | 24/381 |
| 5,822,802 | A | * | 10/1998 | Chou | 2/227 |
| 5,918,310 | A | * | 7/1999 | Farahany | 2/23 |
| 6,378,176 | B1 | * | 4/2002 | Scherer | 24/436 |
| 6,854,130 | B2 | * | 2/2005 | van der Sleesen | 2/69 |
| 6,976,293 | B2 | * | 12/2005 | Traulle et al. | 24/436 |
| 2002/0129470 | A1 | * | 9/2002 | Kiely | 24/433 |

* cited by examiner

*Primary Examiner* — Shelley Self
*Assistant Examiner* — Richale Quinn
(74) *Attorney, Agent, or Firm* — Michael I. Kroll

(57) ABSTRACT

Breakaway sports pants having a slider that when lifted beyond the mating teeth at the top of opposing zipper tracks enables the user to disengage the zipper by pulling the tracks apart rather than sliding the zipper the length of the pants legs.

1 Claim, 11 Drawing Sheets

BREAKAWAY SPORTS PANTS WITH SEPARABLE ZIPPERS

CROSS REFERENCE TO RELATE APPLICATIONS

Related Applications

This application is a continuation-in-part of U.S. patent application Ser. No. 11/650,365, filed 8 Jan. 2007 now U.S. Pat. No. 8,127,370.

Please incorporate by reference all information in said patent application into this continuation-in-part application.

BACKGROUND OF THE INVENTION

1. Field of the Invention

The present invention relates generally to garments and, more specifically, to sports pants having a breakaway zipper. Athletes frequently wear warm-up pants when they are not in play. Players they frequently need to remove them rapidly when entering a game and breakaway pants have become common to enable the user to quickly remove the pants without the need of removing their athletic shoes. They usually fasten at the sides using snaps or Velcro strips as the fastening elements. However, the drawback to those fastening elements is that gaps are located therebetween and Velcro is cumbersome. The present invention overcomes these shortcomings by providing sport pants with breakaway zippers extending the entire length of the sides of the pant legs to provide continuous closure and easy removal thereof.

2. Description of the Prior Art

There are other breakaway sports pants designed for a similar purpose. While these sport pants may be suitable for the purposes for which they were designed, they would not be as suitable for the purposes of the present invention, as hereinafter described.

SUMMARY OF THE PRESENT INVENTION

A primary object of the present invention is to provide breakaway sport pants that facilitate rapid removal thereof.

Another object of the present invention is to provide breakaway sport pants utilizing breakaway zippers disposed on the sides of the pant legs.

Yet another object of the present invention is to provide breakaway sport pants wherein the breakaway zipper eliminates the box that holds one pair of mating ends of the zipper.

Still yet another object of the present invention is to provide breakaway sports pants wherein the zipper slider is disposed at the top ends of mating zipper tracks when in the closed position to maintain the engagement thereof.

Another object of the present invention is to provide breakaway sports pants having a closure flap permanently secured on one side of the zipper and removably securable to the other side with fastening elements.

Yet another object of the present invention is to provide breakaway sports pants wherein said fastening elements are mating hook and loop fasteners.

Still another object of the present invention is to provide breakaway sports pants that are removed from the wearer by opening the closure flap to expose the zipper pull and lifting it and the associated slider thus enabling the user to pull the zipper apart and disengaging the interlocking teeth on the opposing zipper tracks.

Still yet another object of the present invention is to provide breakaway sports pants wherein said zipper pull further includes frictional coating with a lip that will be compressed with the tab.

Additional objects of the present invention will appear as the description proceeds.

The present invention overcomes the shortcomings of the prior art by providing breakaway sports pants having a slider that when lifted beyond the mating teeth at the top of opposing zipper tracks enables the user to disengage the zipper by pulling the tracks apart rather than sliding the zipper the length of the pants legs.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
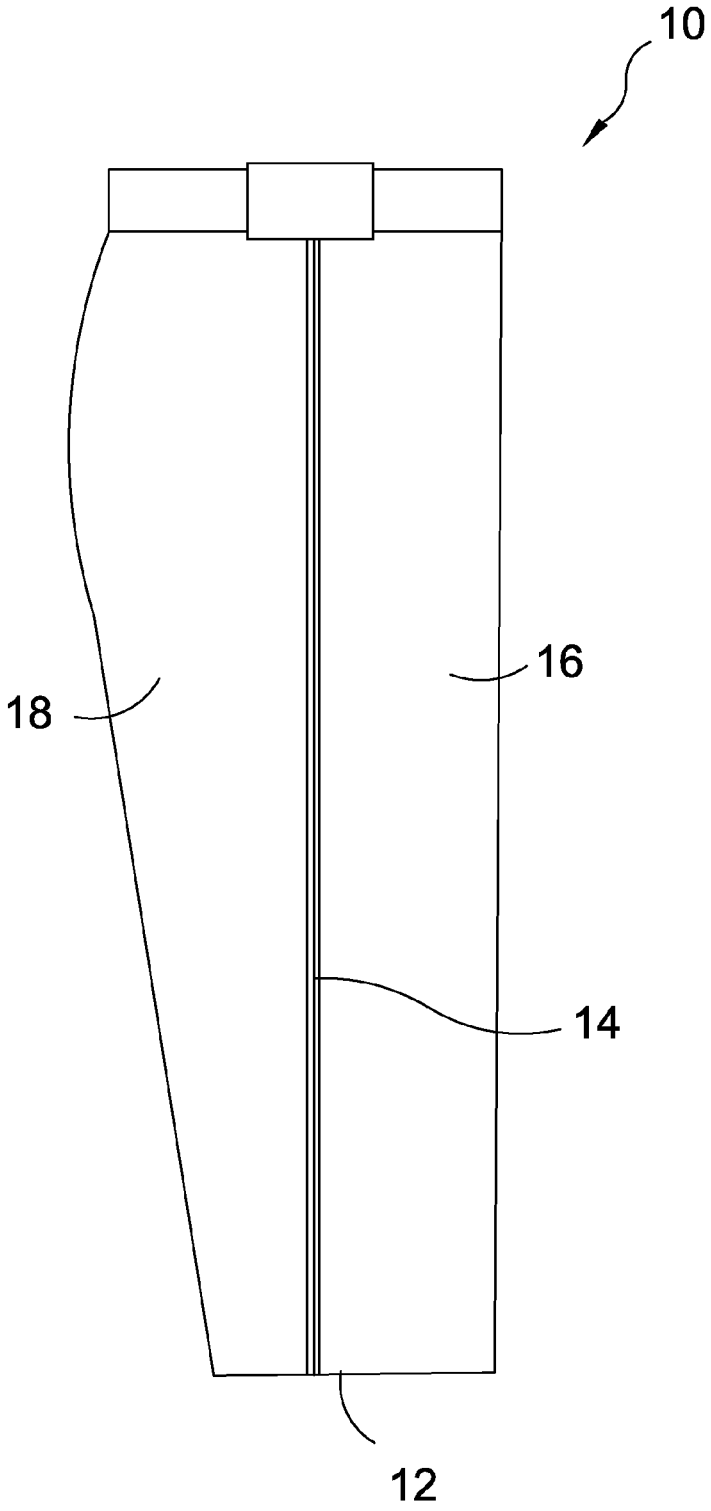
FIG. 1 is a right side view of the present invention.

Turning now descriptively to the drawings, in which similar reference characters denote similar elements throughout the several views, the figures illustrate the Sports Pants with Breakaway Zipper of the present invention. With regard to the reference numerals used, the following numbering is used throughout the various drawing figures.

10 Sports Pants with Breakaway Zipper of the present invention
12 sports pants
14 breakaway zipper
16 front portion of 12
18 back portion of 12
20 left side of 12
22 right side of 12
24 zipper pull
26 slide
28 zipper pull closure flap
30 fastening element
32 hook and loop fastener
34 zipper track
35 first zipper track
36 second zipper track
37 zipper teeth
38 terminus top end of 35
40 terminus top end of 36
42 slide stop
44 seat of 12
46 crotch of 12
48 lipped zipper pull
50 frictional coating
52 lip of 48
54 tab of 26
56 zipper cloth leader

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a right side view of the present invention 10. The present invention 10 is a pair of sports pants 12 having a front portion 16 and a back portion 18 releasably joined by a breakaway zipper 14 extending the length of each pant leg. The breakaway zipper 14 enables the user to quickly and easily remove the pants when needed.

Figure 2:
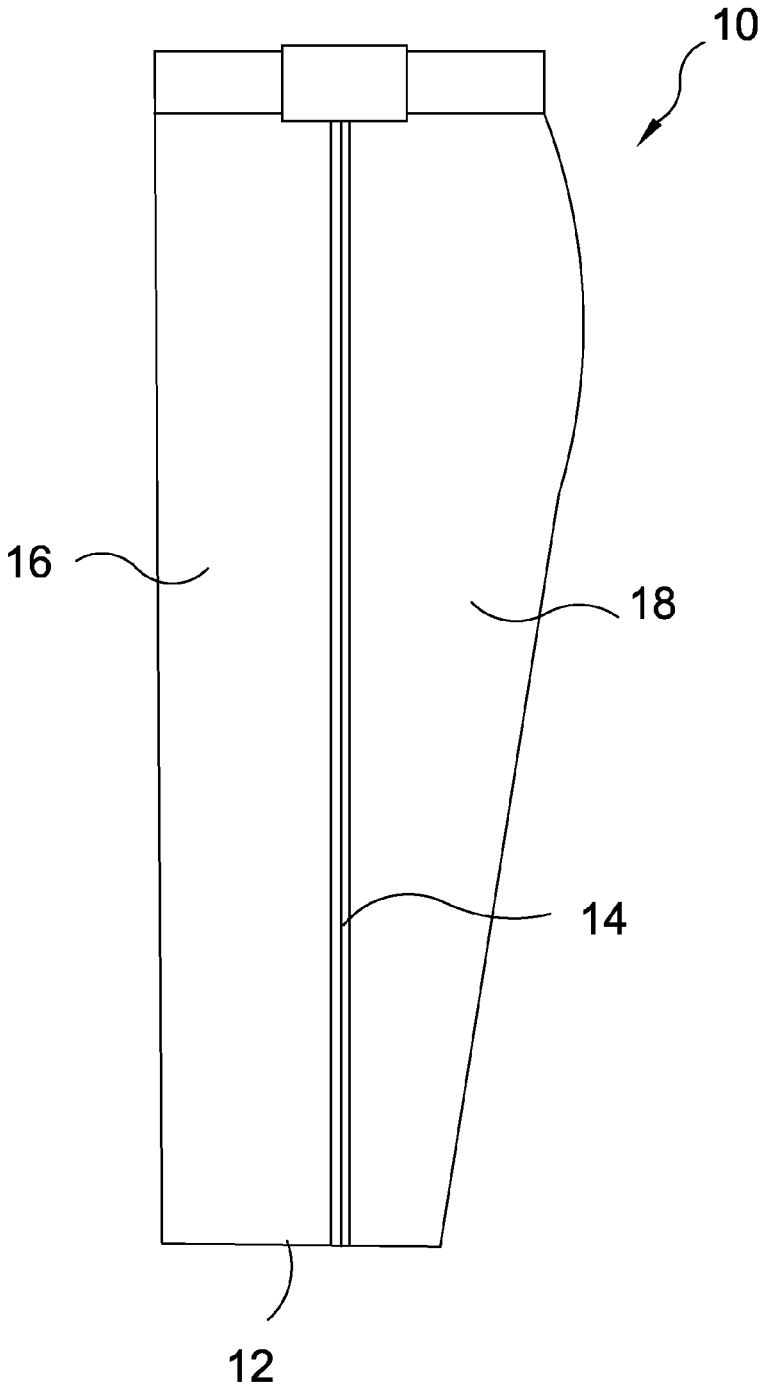
FIG. 2 is a left side view of the present invention.

FIG. 2 is a left side view of the present invention 10. The present invention 10 is a pair of sports pants 12 having a front portion 16 and a back portion 18 releasably joined by a breakaway zipper 14 extending the length of each pant leg. The breakaway zipper 14 enables the user to quickly and easily remove the pants when needed.

Figure 7:
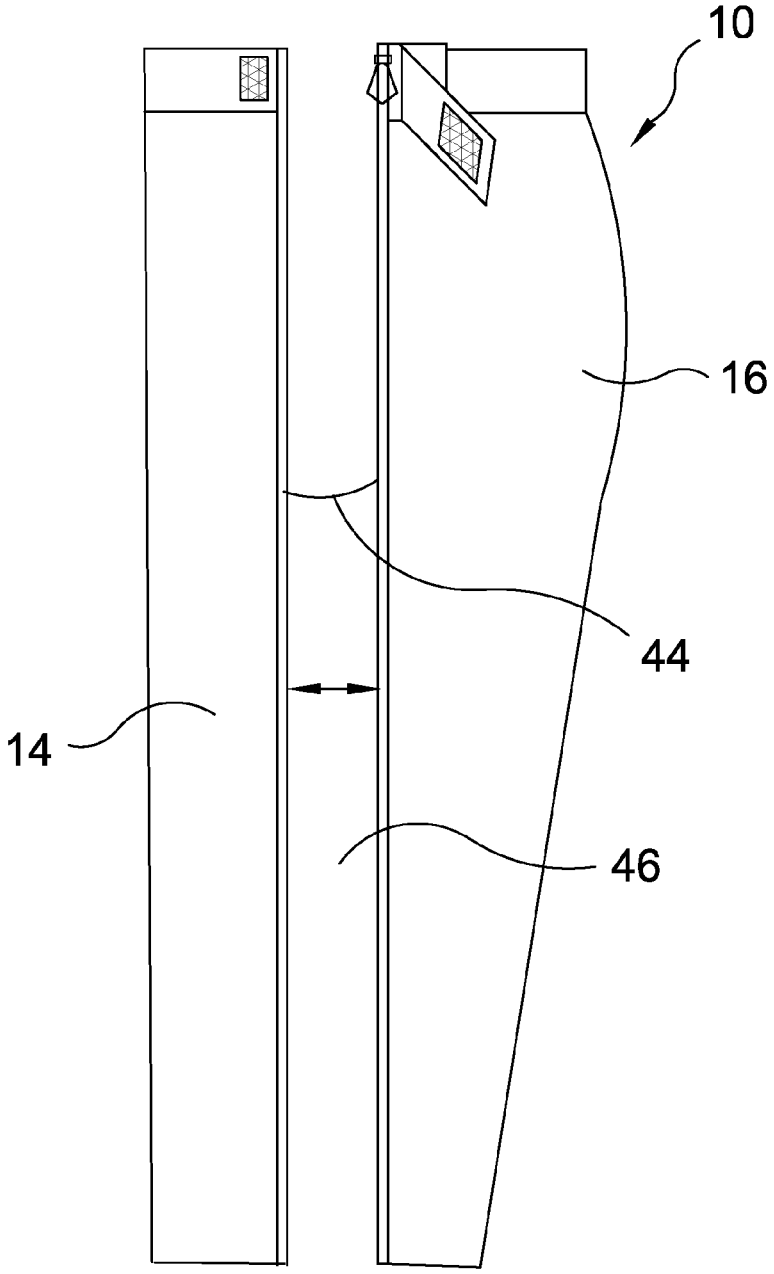
FIG. 7 is a side view of the present invention with the front portion separated from the back portion.

As clearly illustrated in both FIGS. 1 and 2, as well as FIG. 7, the bottoms of the pants legs are ungathered.

Figure 3:
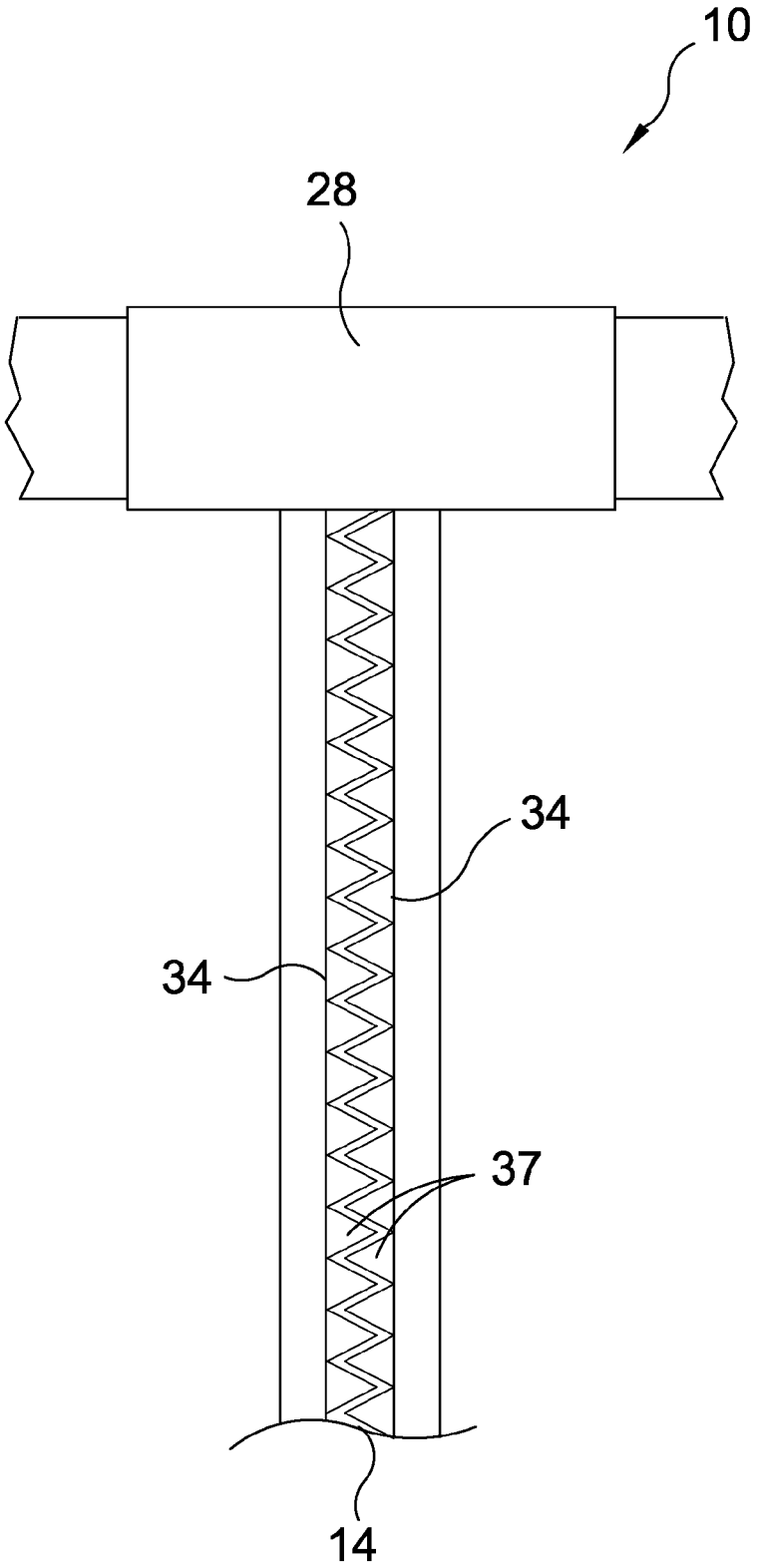
FIG. 3 is a detail view of the closure flap of the present invention in the closed position.

FIG. 3 is a detail view of the closure flap 28 of the present invention 10 in the closed position. The closure flap 28 is fixedly attached to either side and serves to prevent the casual displacement of the slide when the teeth 37 of the mating zipper tracks 34 of the breakaway zipper 14 are interlockingly engaged with each other.

Figure 4:
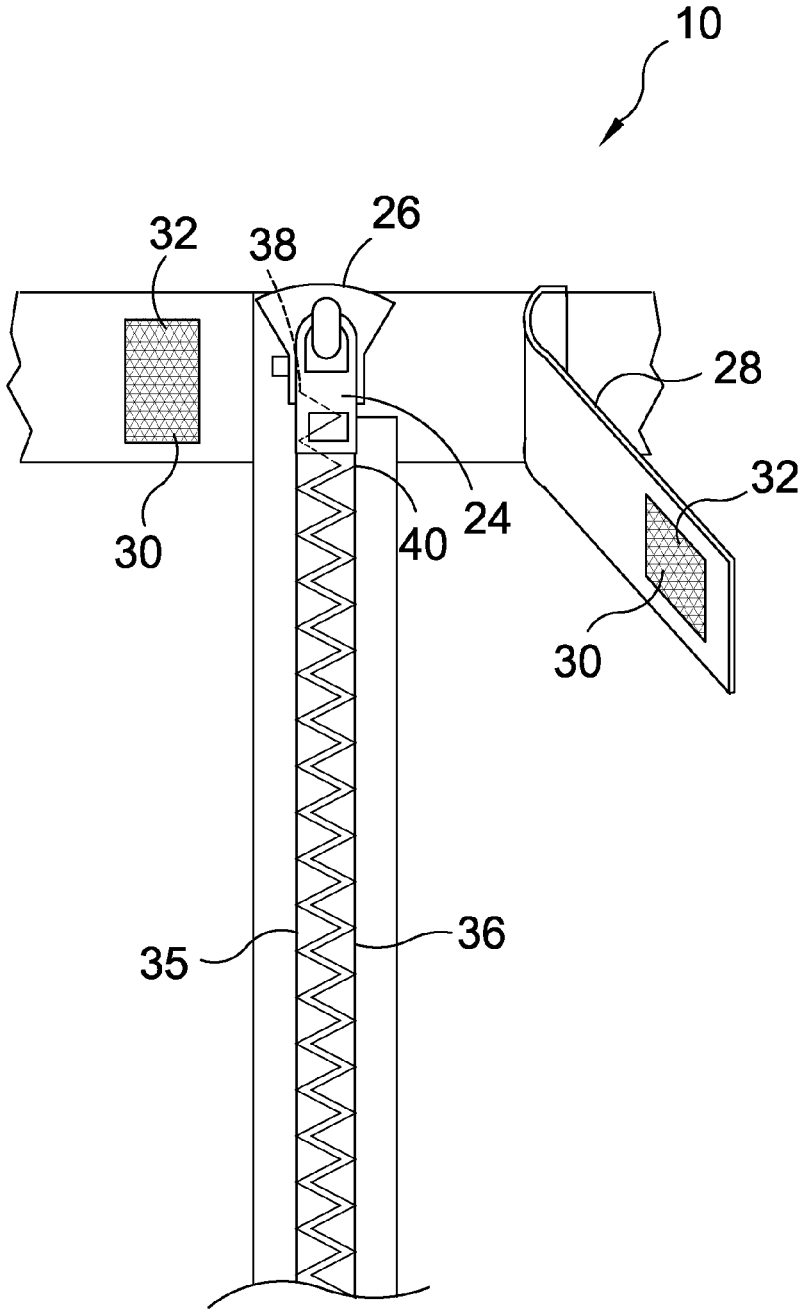
FIG. 4 is a detail view of the closure flap in the open position.

FIG. 4 is a detail view of the closure flap 28 of the present invention 10 in the open position. Opening the closure flap 28 shown in FIG. 3 exposes the zipper pull 24 and slide 26. It is held in the closed position by a fastening element 30, shown here as hook and loop fasteners 32, that can quickly and easily be opened. A catch mechanism may be employed to retain the slide 26 on a track when disengaged without deviating from the concept and objectives of the present invention 10. The variation depicted demonstrates a first zipper track 35 having a top terminus point 38 that extends beyond the top terminus point 40 of the second zipper track 36. The slide 26 is retained on the longer zipper track by stops 42 located the top and bottom points thereof to prevent it from inadvertently falling off the track when disengaged.

Figure 5:
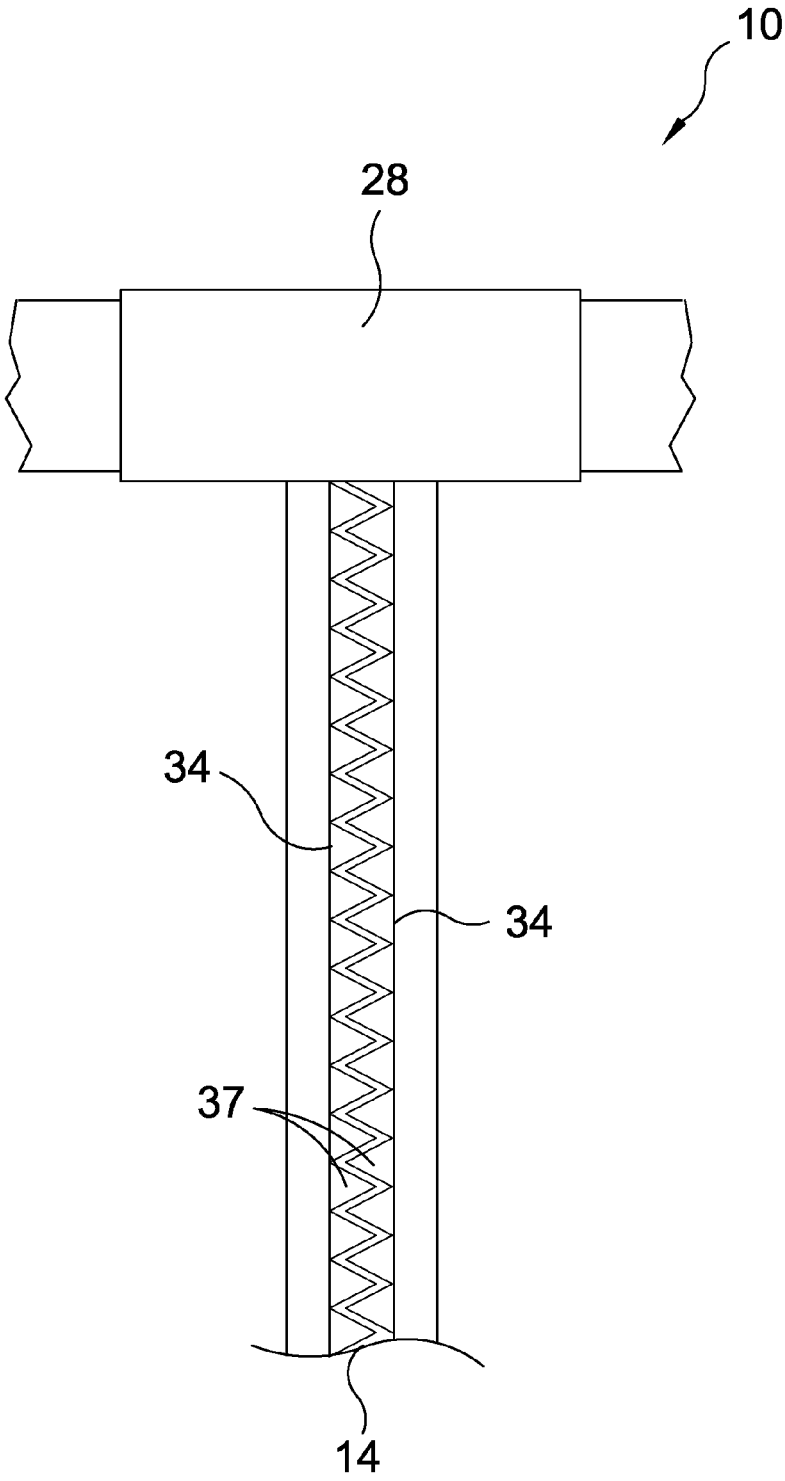
FIG. 5 is a detail view of the closure flap of the present invention in the closed position.

FIG. 5 is a detail view of the closure flap 28 of the present invention 10 in the closed position. The closure flap 28 is fixedly attached to either side and serves to prevent the casual displacement of the slide when the teeth 37 of the mating zipper tracks 34 of the breakaway zipper 14 are interlockingly engaged with each other.

Figure 6:
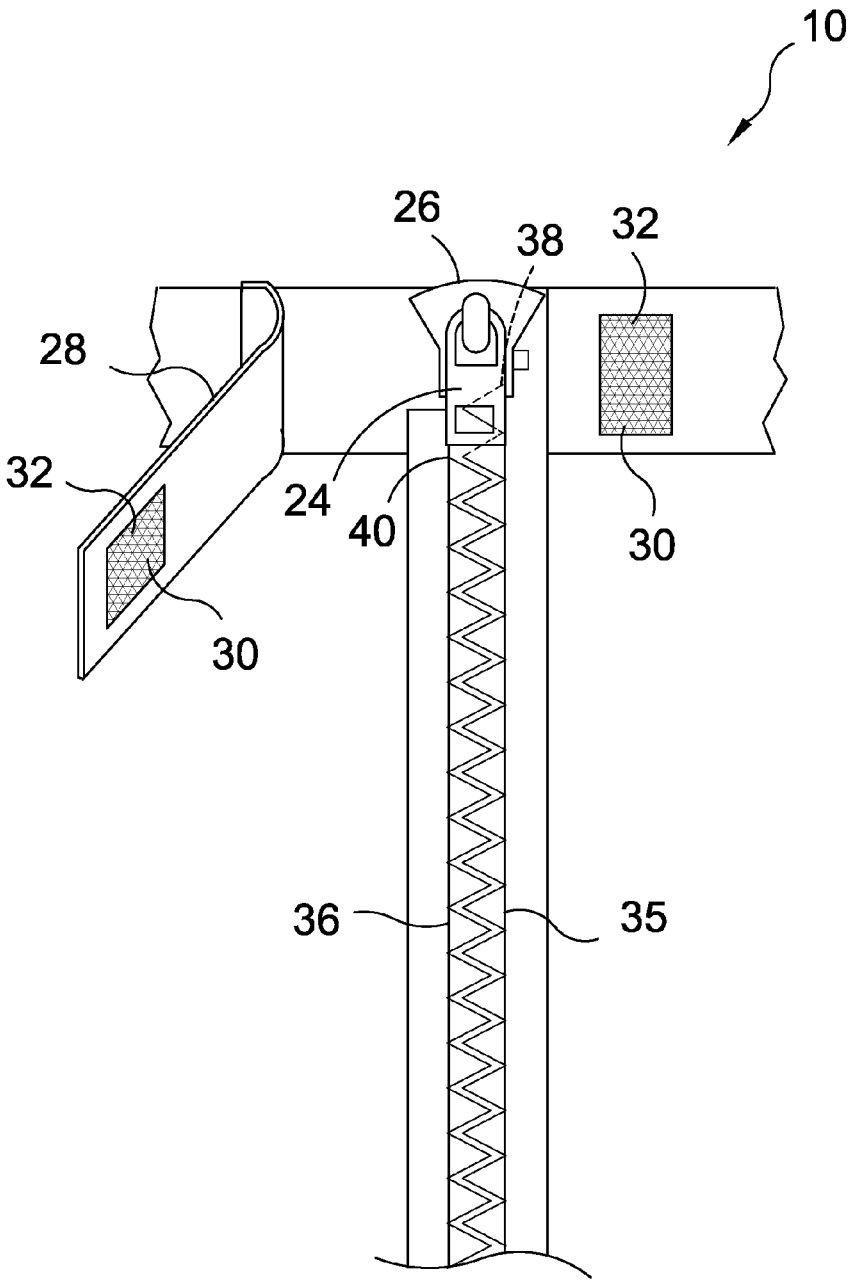
FIG. 6 is a detail view of the closure flap in the open position.

FIG. 6 is a detail view of the closure flap 28 of the present invention 10 in the open position. Opening the closure flap 28 shown in FIG. 5 exposes the zipper pull 24 and slide 26. It is held in the closed position by a fastening element 30, shown here as hook and loop fasteners 32 that can quickly and easily be opened. A catch mechanism may be employed to retain the slide 26 on a track when disengaged without deviating from the concept and objectives of the present invention 10. The variation depicted demonstrates a first zipper track 35 having a top terminus point 38 that extends beyond the top terminus point 40 of the second zipper track 36. The slide 26 is retained on the longer zipper track by stops 42 located the top and bottom points thereof to prevent it from inadvertently falling off the track when disengaged.

FIG. 7 is a side view of the present invention 10 with the front portion 16 separated from the back portion 18 and only connected by the seat 44 and the crotch 46.

Figure 8:
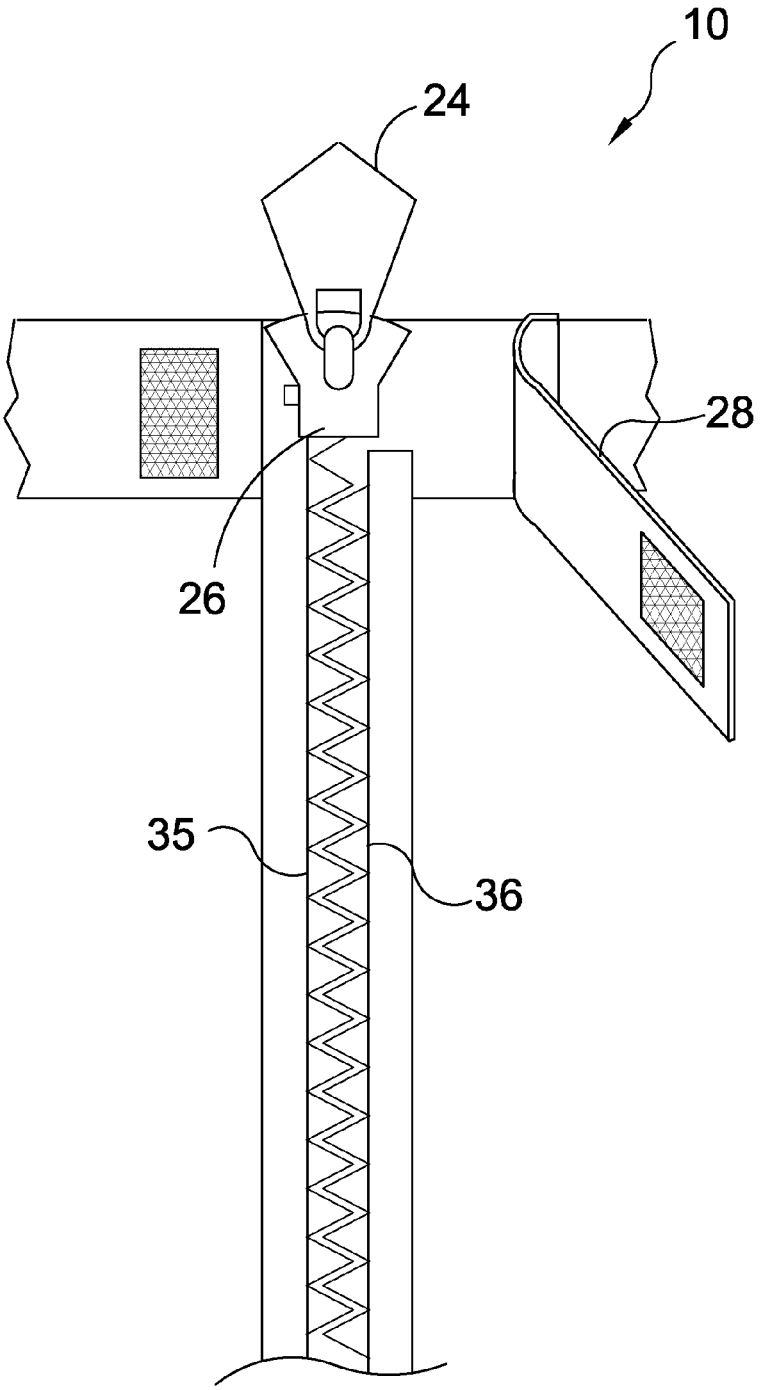
FIG. 8 is a detail view of the closure mechanism of the closure flap in the open position with the zipper pull on the slide in the raised position.

FIG. 8 is a detail view of the closure flap 28 of the present invention 10 in the open position with the zipper pull 24 and the slide 26 in the upright raised position with the first track 35 and the second track 36 prepared to be pulled apart.

Figure 9:
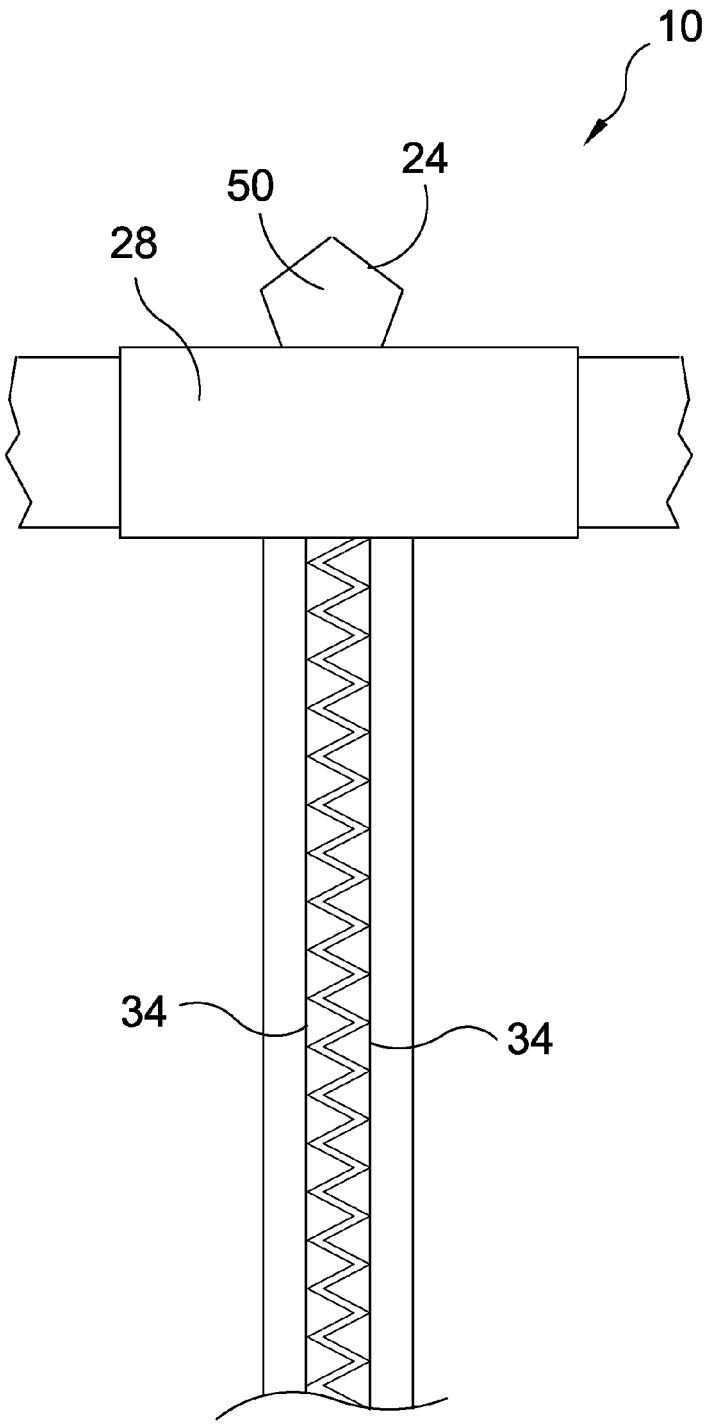
FIG. 9 is a side view of the present invention with the zipper tracks disengaged.

FIG. 9 is a side view of the present invention 10 with the closure flap 28 closed to secure the lowered slide and zipper pull 24 in the lowered position to engage both zipper tracks 34 and prohibit the separation thereof. An additional element of the present invention 10 has the zipper slide 26 including a frictional 50 coating to restrict the inadvertent movement thereof once in place.

Figure 10:
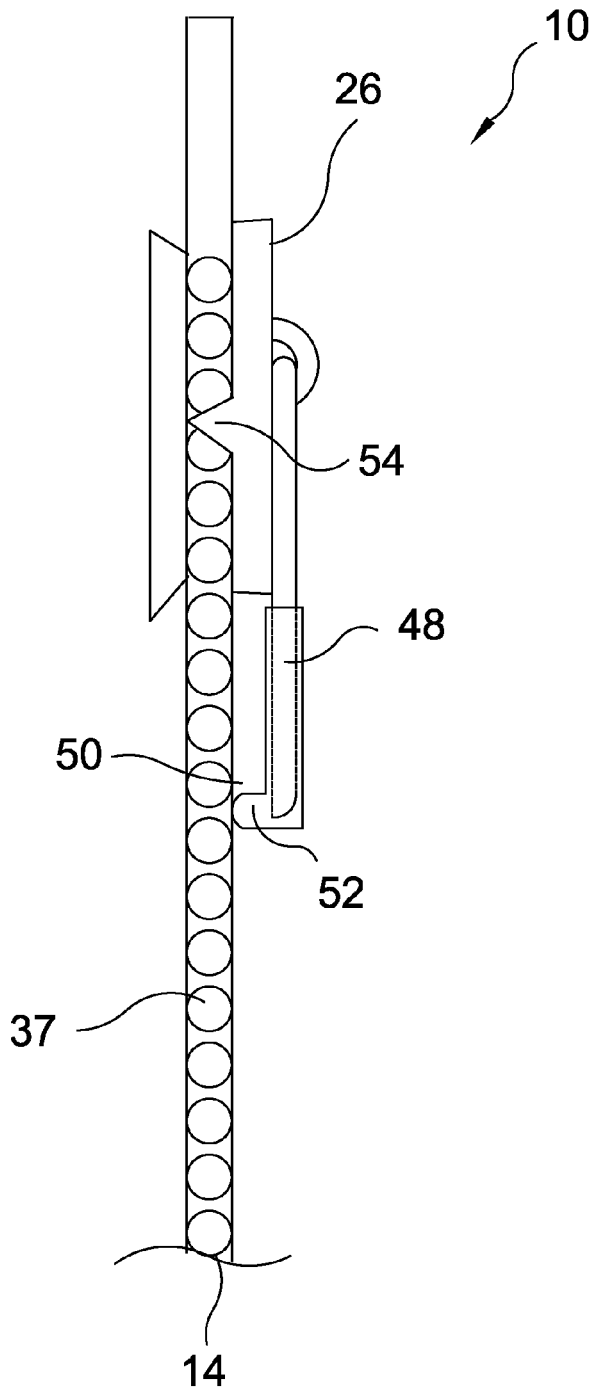
FIG. 10 is a side view of the present invention with a lip projecting therefrom.

FIG. 10 is a side view of a lipped zipper pull 48 of the present invention 10 with a lip 54 projecting therefrom. The lip 54 and slide 26 have a frictional coating 50 and the lip 52 is compressed by the tab 54 restrict movement thereof when the teeth 37 of the breakaway zipper 14 are engaged.

Figure 11:
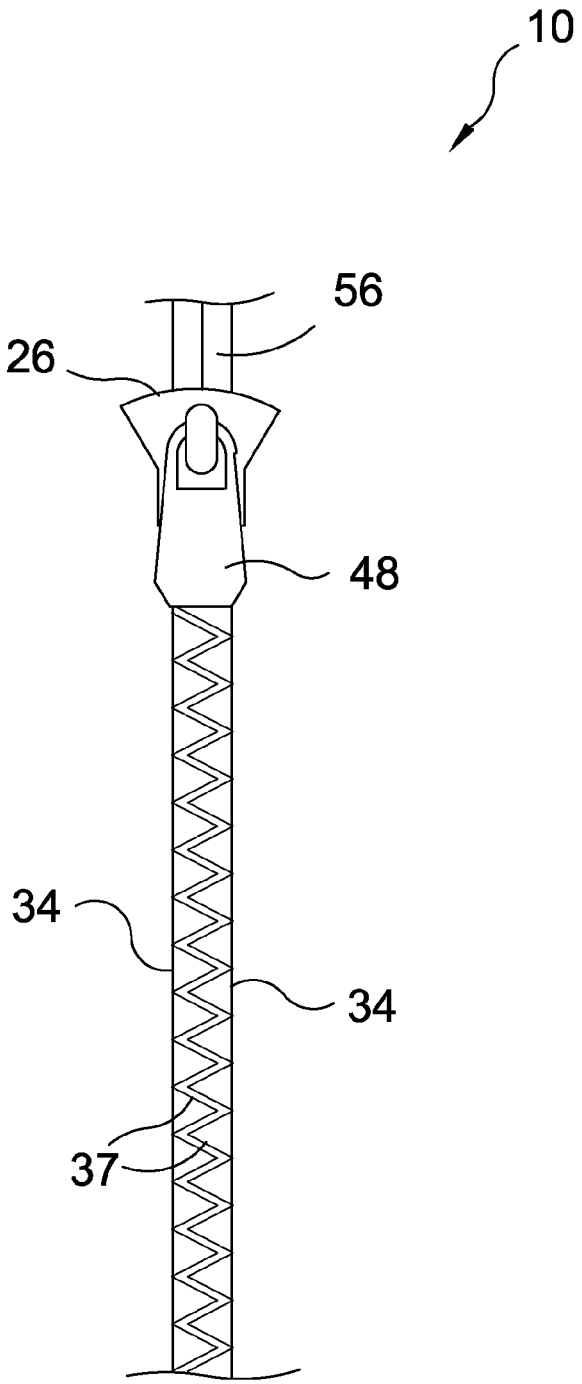
FIG. 11 is a front view of the present invention having zipper pull with a lip.

FIG. 11 is a front view of the lipped zipper pull 48 of the present invention 10 in the lowered, secured position. The slide 26 is engaging teeth 37 of both zipper tracks 34 to prevent them from separating. To disengage the user raises the slide 26 onto the zipper cloth leaders 56 thereby releasing the tracks 34 to enable the user to pull them apart.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. Breakaway sports pants consisting of:

a) a front portion;

b) a back portion affixed to said front portion along a common inseam to form sports pants having an upper waist edge and left and right pant legs each having bottom edges and vertical outseams, said pant legs terminating each at a bottom thereof free of any gathering;

c) a breakaway zipper extending along each said outseam from said upper waist edge to said bottom edge of pant legs, each said breakaway zipper including front and back zipper tracks with matingly interlockable teeth, each of said front and back zipper tracks having separate upper and bottom edge portions such that said front and back zipper tracks form an integral outseam for wearing said sports pants when said matingly interlockable teeth matingly interlock and are completely separable for removing said sports pants when said matingly interlockable teeth are disengaged;

d) a slide slidably affixed to one of each of said front and back zipper tracks, each slide adapted to manipulate its respective teeth between matingly interlocking and disengaged orientations;

e) a closure flap affixed to an upper edge of one of each said front and back zipper tracks, each said closure flap adapted to removably attach to a second of said front and back zipper tracks and over its respective slide when the respective slide is positioned at the upper edge of its respective zipper track and said teeth are matingly interlocked such that each closure flap maintains its respective slide in position at the upper edge of respective zipper track;

f) a zipper pull having a frictional coating affixed to each said slide;

g) a fastening element for removably attaching each said closure flap to a second of said front and back zipper tracks;

h) wherein said fastening element comprises hook and loop fasteners;

i) a first of said zipper tracks has a top terminus point that extends beyond a top terminus point of a second of said zipper tracks;

j) one or more stops located at said top terminus point for retaining said slide on said first zipper track; and k) a lip extending from a distal end of said zipper pull such that said lip presses into said zipper tracks when said closure flap is fastened over said slide, said slide is positioned at said upper edge of said zipper track and said teeth are matingly interlocked;

l) whereby complete breakaway for the entire length of said pants legs allows quick removal of the pants without the need of removing athletic shoes.

* * * * *